US007634993B2

(12) United States Patent
Bellomo

(10) Patent No.: US 7,634,993 B2
(45) Date of Patent: Dec. 22, 2009

(54) GAS MANIFOLD FOR A COOKING RANGE WITH AN EMERGENCY TAP

(75) Inventor: Alberto Bellomo, Ponzano (IT)

(73) Assignee: Coprecitec, S.L., Aretxabaleta (Guipuzcoa) (ES)

( * ) Notice: Subject to any disclaimer, the term of this patent is extended or adjusted under 35 U.S.C. 154(b) by 180 days.

(21) Appl. No.: 12/005,194

(22) Filed: Dec. 26, 2007

(65) Prior Publication Data

US 2008/0251064 A1 Oct. 16, 2008

(30) Foreign Application Priority Data

Jan. 5, 2007 (ES) ..... 200700036

(51) Int. Cl.
*F16K 1/44* (2006.01)
*F16K 11/40* (2006.01)
*F24C 3/00* (2006.01)

(52) U.S. Cl. ..... 126/39 N; 137/561 A; 137/599.01; 137/599.11; 126/42

(58) Field of Classification Search ..... 126/39 N, 126/42; 431/18, 19, 22; 137/561 A, 599.01, 137/599.11; 277/314, 907
See application file for complete search history.

(56) References Cited

U.S. PATENT DOCUMENTS 3,886,738 A * 6/1975 Sien ..... 60/277
4,709,687 A 12/1987 Barnes
4,953,592 A * 9/1990 Takahashi et al. ..... 137/599.11
5,694,916 A 12/1997 Gambill et al.
5,904,174 A * 5/1999 Carew et al. ..... 137/329.2
5,979,430 A 11/1999 Peed et al.
6,047,734 A * 4/2000 Robinson ..... 137/625.37
6,241,424 B1 * 6/2001 Bath et al. ..... 405/156
6,289,792 B1 9/2001 Grando et al.
6,601,604 B1 * 8/2003 Cooper ..... 137/269
6,907,898 B2 * 6/2005 White et al. ..... 137/460
7,124,779 B2 * 10/2006 Syse ..... 138/89
7,275,367 B2 * 10/2007 Tamura et al. ..... 60/324
7,513,681 B2 * 4/2009 Kingsford ..... 366/340
2001/0054234 A1 * 12/2001 Asta et al. ..... 29/890.02
2005/0241475 A1 * 11/2005 Syse ..... 92/165 R

FOREIGN PATENT DOCUMENTS

GB 2179134 A * 2/1987

* cited by examiner

*Primary Examiner*—Kenneth B Rinehart
*Assistant Examiner*—Frances Kamps
(74) *Attorney, Agent, or Firm*—Tim L. Kitchen; Peter B. Scull; Berenbaum Weinshienk PC

(57) ABSTRACT

Gas manifold (1) for a cooking device that includes a distributor conduit (2) of a gas flow (Q) formed by a cylindrical pipe of a certain uniform diameter (D1) fitted with a plurality of regulation taps (3), and that is provided with a manually operated emergency tap (4) at the gas inlet, with a cut-off valve (10) disposed in parallel in relation to the distributor conduit (2), in which a seal device (13) of the passage of the flow (Q) is intercalated in the interior of the conduit (2) between an inlet (8) and an outlet (9) of the emergency tap (4), as a result of which all the flow (Q) is diverted to the emergency tap (4), thereby bypassing the seal device (13). The sealing of the distributor conduit (2) is made by means of a circular disc (14) and a ring sealing gasket (15).

9 Claims, 2 Drawing Sheets

GAS MANIFOLD FOR A COOKING RANGE WITH AN EMERGENCY TAP

TECHNICAL FIELD

The present invention relates to the supply of gas to a domestic cooking device by means of a gas manifold fitted with a number of regulation taps of an individual gas flow assembled on a distributor conduit, and of an emergency valve connected at the inlet of the gas manifold.

PRIOR ART

A gas manifold of the aforementioned type is known, fitted with a plurality of manual regulation taps assembled along a distributor conduit, such as that disclosed in U.S. Pat. No. 5,979,430 for a cooking device, in which the end of the inlet of the distributor conduit has a cylindrical cross-section and is directly connected to a gas outlet of the cooking device.

A gas manifold with an emergency valve disposed at the inlet of the distributor conduit in order to interrupt the passage of gas by means of an emergency button is also known, as disclosed in U.S. Pat. No. 5,694,916 or in U.S. Pat. No. 6,289,792. These emergency valves are connected in series with the distributor conduit, and their valve member is intercalated in the distributor conduit. Further, these emergency valves are of the electrically operated type.

U.S. Pat. No. 4,709,687 discloses a safety valve for a gas manifold to a cooking range, which has a button operated by the cooking range cover. This manual safety valve is assembled on an auxiliary segment of the conduit, which is connected in series with the inlet of the distributor conduit.

DISCLOSURE OF THE INVENTION

The object of the invention is to provide a gas manifold fitted with a number of manual regulation taps assembled on a long distributor conduit of the gas flow to a cooking device, and provided with an emergency tap or valve assembled on the distributor conduit with a cut-off valve in parallel to the conduit, as a result of which the inlet flow is diverted towards the emergency tap with the distributor conduit being closed between the inlet and outlet of the cut-off valve by means of an airtight seal device.

An emergency tap connected in parallel to the distributor conduit has advantages over the taps in the prior art, in which the cut-off valve is intercalated in the distributor conduit itself. The manual emergency tap connected in parallel to the distributor conduit, is inexpensive due to its simple operation and its simple connection outside the gas pipe. In order to install an emergency tap that cuts the gas flow at the inlet of the distributor conduit, it is necessary to intercalate an airtight seal in the interior of the distributor conduit so that all the inlet flow is diverted towards the emergency tap, thereby bypassing said airtight seal.

The airtight seal in the gas inlet comprises a simple device that is incorporated on one end of the same distributor conduit, before being bent or twisted so that it can be fitted to the regulation taps and the cooking range. The seal device comprises a circular disc made of a deformable material and provided with a ring sealing gasket that expands diametrically with the disc to close permanently against the internal wall of the distributor conduit.

DETAILED DISCLOSURE OF THE INVENTION

Figure 1:
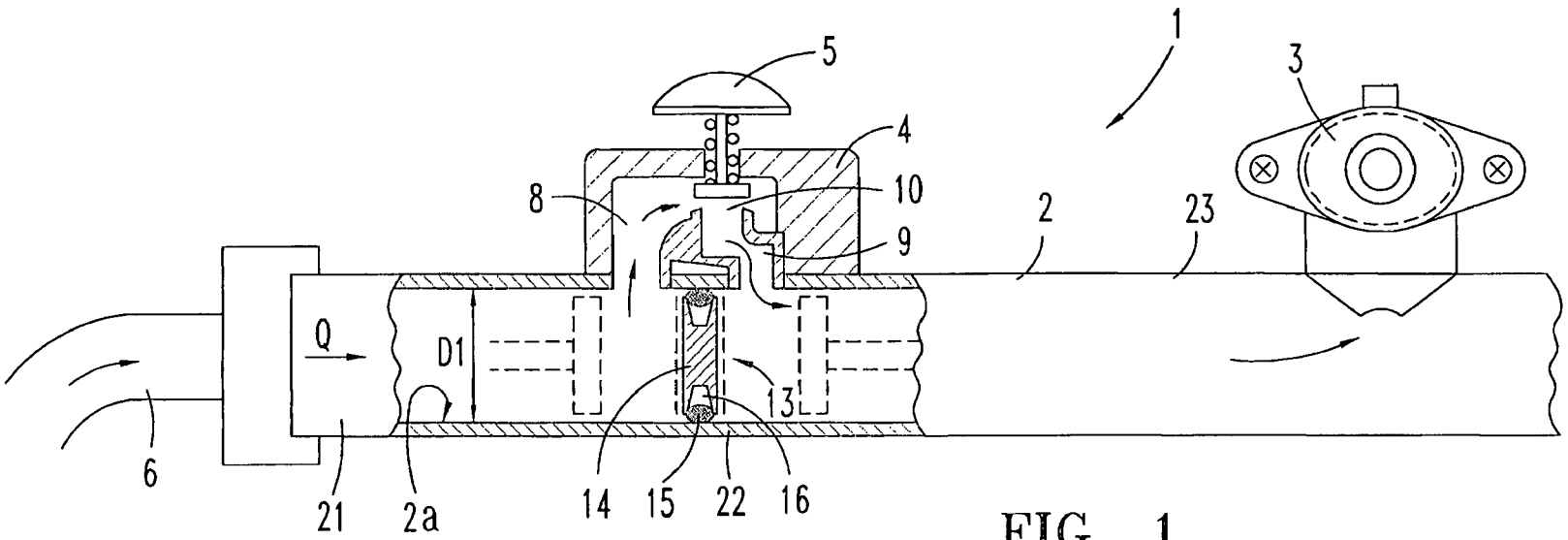
FIG. 1 is a view of a gas manifold for a cooking device showing, in a partial section, an emergency valve at the inlet of the distributor conduit.
Figure 2:
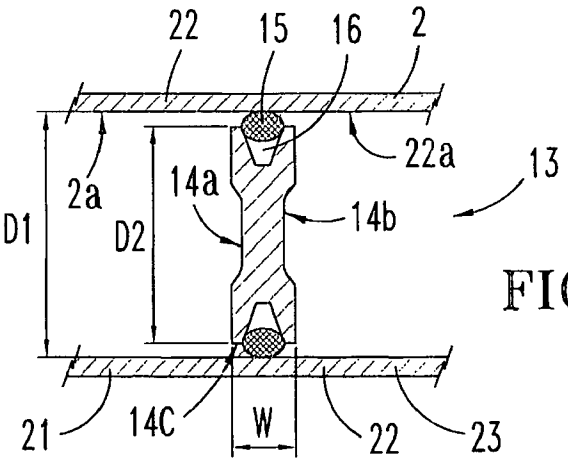
FIG. 2 is a view in detail of the gas inlet in the gas manifold of FIG. 1 showing a device with a seal device with a seal disc according to a first embodiment of the invention.

In reference to FIGS. 1 and 2, an embodiment of the gas manifold 1 comprises a long distributor conduit 2 of a gas flow Q made of a cylindrical pipe, which is connected at one end to an outlet 6 of the gas source in a cooking device, a plurality of regulation taps 3 for the flow Q, preferably of the rotary type assembled on the conduit 2, a tap or emergency valve 4 of the type operated manually by means of an emergency button 5 that comprises a cut-off valve 10 connected in parallel to a segment 22 of the distributor conduit 2, and an internal airtight seal device 13 of the distributor conduit 2 intercalated in the interior of said segment of conduit 22, between the inlet 8 and the outlet 9 of the emergency tap.

The segment of conduit 22 bearing the emergency tap 4 is followed by the conduit end 21 that is connected to the gas outlet 6 of the cooking range. The button 5 is adapted in order to operate the cut-off valve 10 suddenly and thus shut off the inlet of flow Q. The regulation taps 3 are assembled spaced apart from each other on a long segment 23 upstream from the distributor conduit 2, and each of them connected in parallel in relation to the flow Q of gas.

The passage of the inlet flow Q in the manifold 1 is established first of all through the emergency tap 4, extending beyond the airtight seal device 13 and passing through the distributor segment 23 of the conduit.

In reference to FIG. 2, the tubular segment of the conduit 2 incorporates the seal device 13 in its interior, formed by a deformable seal disc 14 and a ring sealing gasket 15. In a first embodiment, shown in said FIG. 2, the seal disc 14 has a cylindrical edge 14*c* with a width W, on which a V-shaped radial groove 16 is formed for housing and guiding a ring sealing gasket 15. The seal device 13 is incorporated in the interior of the distributor conduit 2, of a specific diameter D1, in an initial operation, before being connected to the gas outlet 6 of the appliance, and also before the conduit 2 is bent.

In order to be introduced in the intermediate segment 22*a* of the pipe, the initial diameter of the seal device 13 is smaller or similar to that of the internal wall 22*a* of the intermediate segment of the pipe. Thus, the end 21 of the pipe for the gas outlet 6 and the intermediate segment 22 of the pipe for the installation of the emergency tap 4 and the seal device 13 may be part of the same cylindrical conduit 2, with equal diameters D1 between them. The diameter D2 of the deformed disc 14 is smaller than the interior diameter D1 of the conduit 2, in a sufficient proportion to create a space of expansion for the disc 14 and the sealing gasket 15.

The seal disc 14 is made of a material that is deformable with an axial pressure, such as aluminium, and has a first pressure base 14*a* and a second pressure base 14*b*, through which the deformation causes the diametrical expansion up to a specific diameter, somewhat smaller or similar to that of the internal diameter D1.

As a result of the expansion of the disc 14, the ring sealing gasket 15 expands more than the diameter D1 of the internal wall 22*a* of the pipe, thereby forming a permanent airtight seal beneath the emergency cut-off valve 10. In order to deform the seal disc 14 and cause its diametrical expansion, a deformation device, for example with two pistons, is used, the axial force of which is exerted on both pressure bases 14*a* and 14*b*, the deformation device subsequently being removed.

The V-shaped groove 16 on the disc guides the ring sealing gasket 15 and holds it in place when the disc 14 is deformed, and at the same time pushes the ring sealing gasket 15 against the internal wall 22*a* of the pipe.

Figure 3:
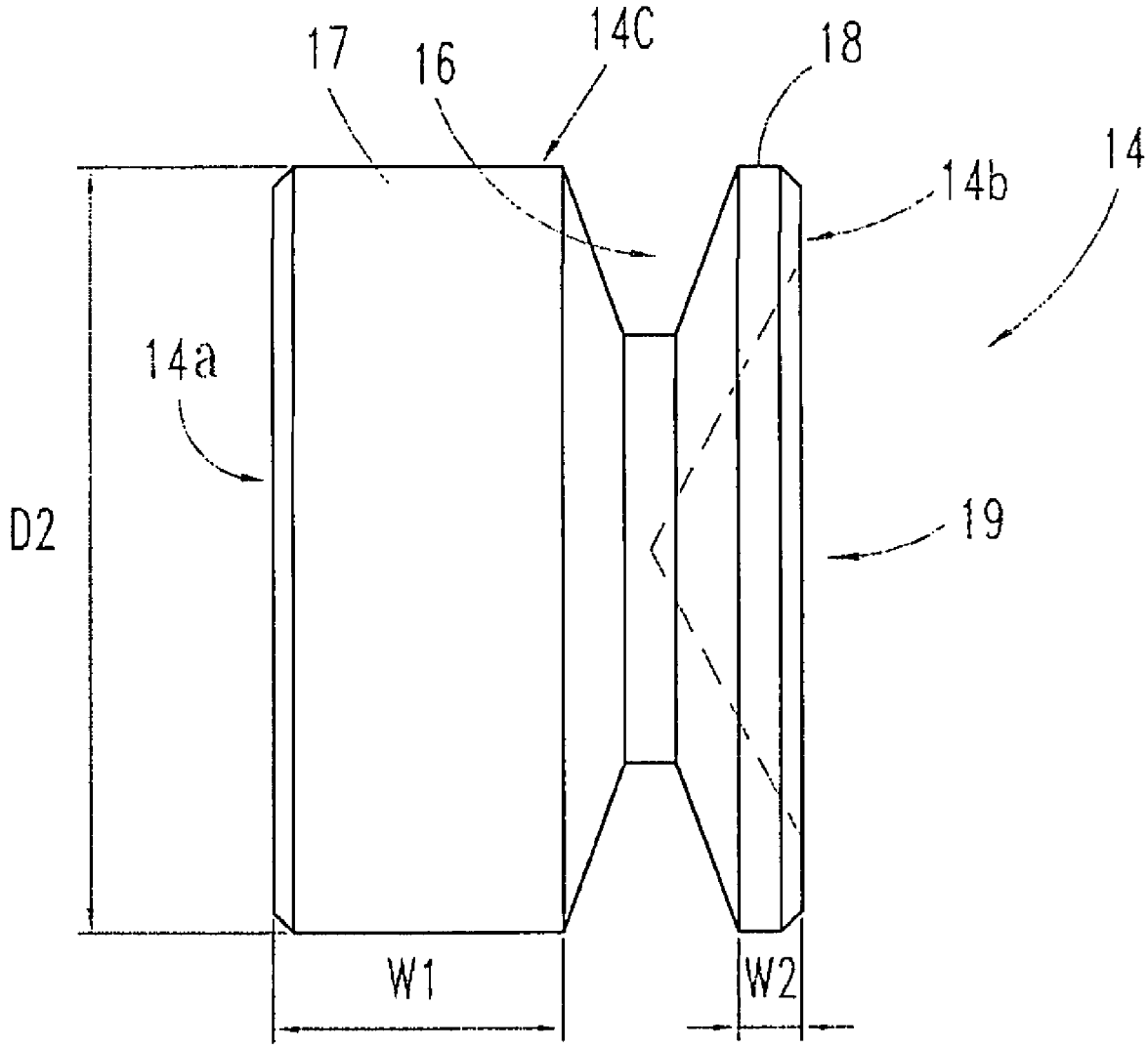
FIG. 3 is a side view of a seal disc according to a second embodiment of the invention.

FIG. 3 shows a second embodiment of the seal disc 14. In this second embodiment, the disc seal 14 comprises a cylindrical edge 14*c* as well, in which a V-shaped radial groove 16 is formed, for the housing and guiding of a ring sealing gasket, not shown in FIG. 3. The seal disc 14 comprises, on both sides of said radial groove 16, respective cylindrical segments 17 and 18 of different width and a diameter D2, the respective bases of said cylindrical segments 17 and 18 forming the pressure bases 14*a* and 14*b*.

As shown in FIG. 3, the width W1 of the cylindrical segment 17 is substantially bigger than the width W2 of the cylindrical segment 18 and also bigger than the maximum width of the radial groove 16. The fact that the cylindrical segment 17 has this width W1 makes the insertion of the seal disc 14 in the distributor conduit 2 be easier during the assembly, because it allows the guiding of said seal disc 14 in the interior of the distributor conduit 2. Further, it also makes the application of the axial force by means of a deformation device easier.

The pressure base 14*a* of the cylindrical segment 17 is substantially flat, and the pressure base 14*b* of the cylindrical segment 18 comprises a cone shaped cavity 19. During the assembly, a first piston with a flat surface is supported on the flat surface of the pressure base 14*a*, and a second piston with a conical end pressures on the cavity 19 of the base 14*b*, the seal disc 14 getting deformed and obtaining the sealing. The cavity 19 allows centering the piston and contributes to have less thickness in the part of the seal disc 14 that gets deformed by means of the axial force exerted by the second piston. The width W2 of the cylindrical segment 18 is substantially smaller than the maximum width of the radial groove 16.

In the embodiment shown in FIG. 3, the width W1 of the cylindrical segment 17 is approximately five times bigger than the width W2 of the cylindrical segment 18.

The invention claimed is:

1. A gas manifold for a cooking device, comprising a distributor conduit made of a cylindrical pipe of a certain diameter fitted with a plurality of regulation taps for the supply of a gas flow to the cooking device, wherein one gas inlet end to the distributor conduit is connected to a gas outlet of the cooking device, the gas manifold being provided with an emergency tap in said gas inlet end, assembled on a conduit segment situated between said gas inlet end and the regulation taps, the emergency tap comprising a cut-off valve disposed in parallel in relation to the distributor conduit, the gas manifold also comprising an airtight seal device intercalated in the interior of the distributor conduit between an inlet and an outlet of the emergency tap in the direction of the gas flow.

2. The gas manifold according to claim 1, wherein the inlet end of the distributor conduit and the conduit segment in the interior of which is disposed said seal device are of an internal diameter that is uniform with the distributor conduit for the regulation taps.

3. The gas manifold according to claim 1, wherein said seal device is formed by a seal disc made of a plastically deformable material for its diametrical expansion, and upon whose peripheral cylindrical edge a ring sealing gasket is guided for the sealing of the distributor conduit.

4. The gas manifold according to claim 3, wherein the seal disc comprises in its cylindrical edge a V-shaped radial groove for the housing and guiding of the ring sealing gasket.

5. The gas manifold according to claim 4, wherein the seal disc comprises a respective cylindrical segment on both sides of the radial groove.

6. The gas manifold according to the claim 5, wherein the seal disc comprises a wide cylindrical segment on one side of the radial groove and a narrow cylindrical segment on the other side of said radial groove, the wide cylindrical segment having a thickness bigger than the maximum thickness of the radial groove, and the narrow cylindrical segment having a thickness smaller than the maximum thickness of said radial groove.

7. The gas manifold according to claim 6, wherein the wide cylindrical segment comprises a substantially flat pressure base.

8. The gas manifold according to claim 6, wherein the narrow cylindrical segment comprises a pressure base that comprises a cone shaped cavity.

9. The gas manifold according to claim 6, wherein the width of the wide cylindrical segment is approximately five times bigger than the width of the narrow cylindrical segment.

* * * * *